United States Patent [19]

Wetherby

[11] 4,058,296

[45] Nov. 15, 1977

[54] MIXING APPARATUS

[75] Inventor: Edward M. Wetherby, Westchester, Ill.

[73] Assignee: Graymills Inc., Chicago, Ill.

[21] Appl. No.: 673,582

[22] Filed: Apr. 5, 1976

[51] Int. Cl.[2] ..... B01F 15/00

[52] U.S. Cl. ..... 366/160; 137/604; 137/599; 366/163

[58] Field of Search ..... 259/4 R; 137/604, 599, 137/186; 239/310, 317

[56] References Cited

U.S. PATENT DOCUMENTS

| | | | |
|---|---|---|---|
| 3,181,797 | 5/1965 | Hayes | 239/317 |
| 3,806,037 | 4/1974 | Loewenkamp | 239/310 |

*Primary Examiner*—William Price
*Assistant Examiner*—Douglas B. Farrow
*Attorney, Agent, or Firm*—Neuman, Williams, Anderson & Olson

[57] ABSTRACT

An apparatus is provided for mixing two or more fluids together in a desired ratio. The mixing apparatus includes primary and secondary conduits, one extending from a source of a first fluid and the other extending from a source of a second fluid, and a diversion conduit extending between the primary and secondary conduits and through which a selected amount of the first fluid will be diverted from the primary conduit. An eductor, position in the primary conduit, is connected to the secondary conduit so that the second fluid will be drawn from a source and will intermix with a selected flow of first fluid through the diversion conduit prior to entering the eductor. Upon entering the eductor the premixed fluids combine with the first fluid flowing through the eductor from the primary conduit. The amount of premixed fluids which combines with the first fluid in the eductor is dependent upon the flow of first fluid in the primary conduit through the eductor.

9 Claims, 3 Drawing Figures

MIXING APPARATUS

BACKGROUND OF THE INVENTION

This invention relates to mixing apparatus, and more particularly mixing apparatus of a type employed to mix fluids together in a desired ratio.

Mixing apparatus are frequently employed in offset printing press operations where it is desirable to apply a mixture of etch concentrate dissolved in water to the nonprinting portions of a printing plate mounted on a plate cylinder. Damping rollers, which roll through a fountain pan filled with the mixture, apply it to the printing plate. The quality of printed material produced will depend upon the accuracy with which the mixture may be regulated to correspond to different ink or paper types.

In the past, some mixing apparatus have utilized a bypass conduit arrangement in combination with a main conduit wherein a number of eductors, a series of conduit restrictions, and/or a system of valves were required to effectuate accurate proportional mixing of two fluids. The first fluid was forced into the bypass conduit in such prior structures, due to valve or restriction arrangements, and would flow through an eductor disposed within the bypass conduit thereby causing a second fluid to be drawn into the first fluid and become premixed prior to being further mixed with the first fluid flowing into the main conduit. With such prior structures, when it was desired to increase the proportionate amount of second fluid to be mixed with the first fluid, flow of the first fluid through the main conduit had to be restricted (i.e., by a valve) so that a larger head pressure would be built up in the bypass conduit, thereby increasing the lifting suction generated by the eductor located therein, while at the same time restricting the amount of first fluid flowing through the main conduit. Thus, such prior apparatus depended upon critical relationships of fluid pressures, in order to attain the desired mixing ratio of the fluids which necessitated additional components such as an eductor in the bypass conduit.

Other mixing apparatus either relied upon a gravity feed system thereby restricting the location of the apparatus; mix the fluids together in a fixed predetermined ratio and then accumulate same in a storage reservoir or the like; or introduce a second fluid in an undiluted state directly into the main fluid conduit, with or without employing an eductor. Thus, the prior mixing apparatus were complicated in design often requiring a multiplicity of parts, both electrical and mechanical, and were costly and difficult to manufacture and service.

OBJECTS OF THE INVENTION

It is an object of the invention to provide an improved mixing apparatus which avoids the shortcomings associated with prior structures of this general type.

It is a further object of the present invention to provide an improved, low cost, and simplified mixing apparatus for readily mixing two fluids together in a desired ratio regardless of the variations in the flow rate of one fluid through a main conduit of the apparatus.

It is still another object of this invention to provide a mixing apparatus which is versatile, and may be employed in a variety of arrangements where a mixture of fluids is necessary.

SUMMARY OF THE INVENTION

The objects of this invention are achieved by a mixing apparatus according to a preferred embodiment which assures accurate mixing of two fluids in a predetermined ratio. Fluid from a first source, under pressure, flows through a primary conduit and an eductor integral with the primary conduit before exiting the apparatus. Fluid from a second source is drawn through a secondary conduit and into the primary conduit at the eductor, to which the secondary conduit is connected. A diversion conduit extends between and is connected at one end to the primary conduit upstream of the eductor and at the opposite end of the secondary conduit upstream of the connection between the secondary conduit and the eductor. By reason of the arrangement of the conduits, a predetermined amount of fluid from the first source is drawn into the diversion conduit and then intermixed with fluid drawn from the second source through the secondary conduit. The intermixed fluids then flow into the eductor and entrain with the first fluid flowing through eductor from the primary conduit. A valve means mounted in the diversion conduit regulates the amount of fluid from the first source that is allowed to be diverted into the diversion conduit. The flow of fluids drawn through the diversion conduit and the secondary conduit is dependent on the first fluid flow in the primary conduit through the eductor.

For a more complete understanding of this invention, reference should now be had to the embodiment illustrated in greater detail in the accompanying drawings and described below by way of an example of the invention.

While the invention will be described in connection with a preferred embodiment, it is to be understood that the invention is not intended to be limited thereto.

DESCRIPTION OF THE PREFERRED EMBODIMENT

Figure 1:
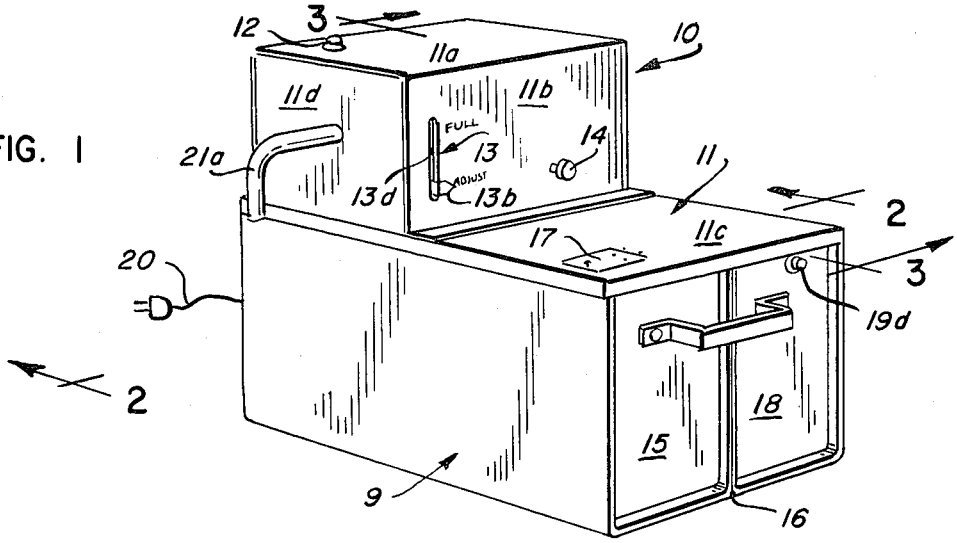
FIG. 1 is a perspective view of the preferred embodiment of a mixing apparatus employing principles of this invention with a cover therefor shown in place.

Referring now to the drawings and principally FIG. 1, a preferred embodiment of the improved mixing apparatus 10 is shown. The apparatus includes a protective housing 9 provided with a cover 11. Disposed within the housing are various components of the apparatus to be hereinafter described.

Figure 2:
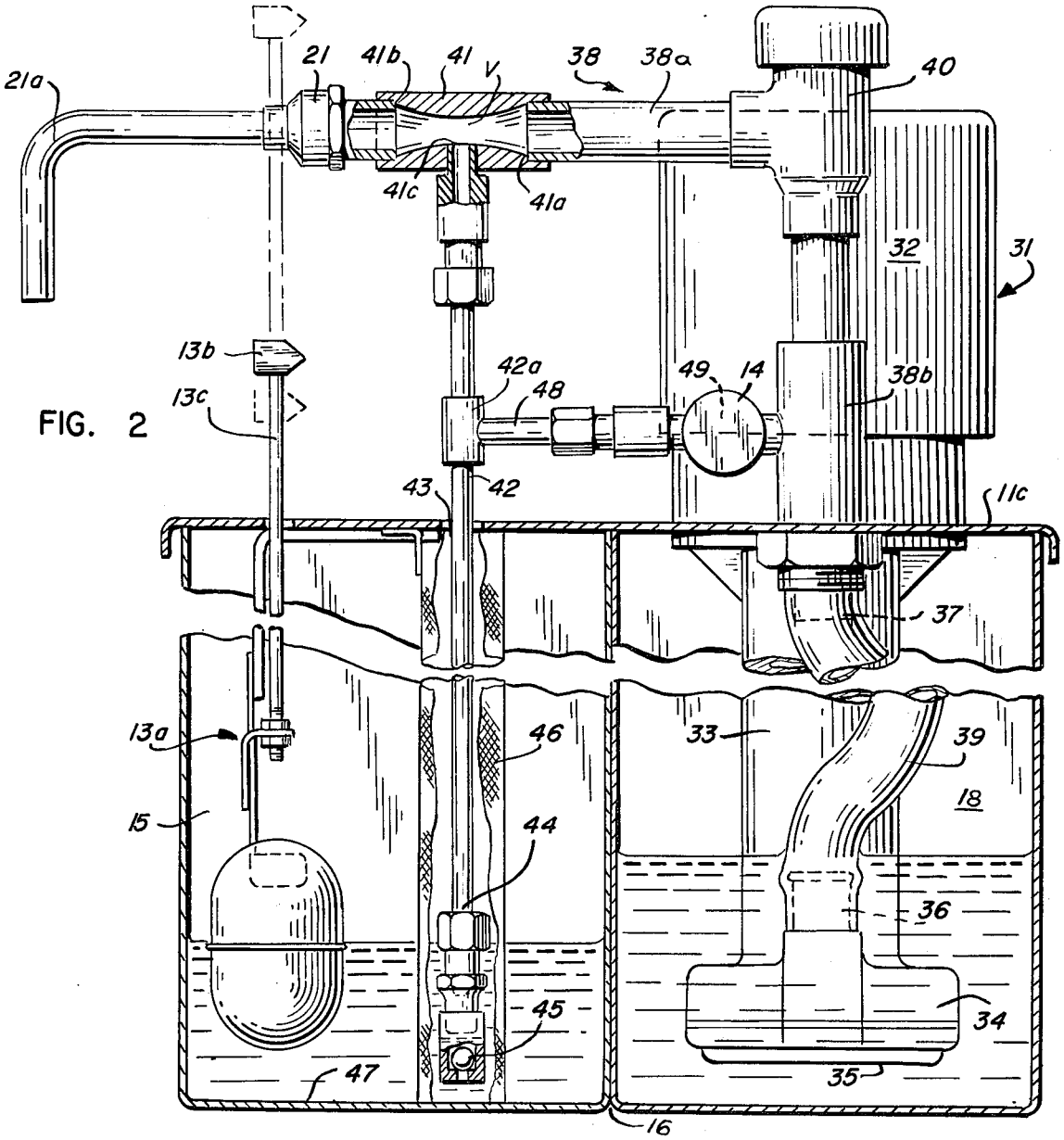
FIG. 2 is an enlarged fragmentary sectional view taken along line 2—2 of FIG. 1, with the cover removed, and with portions of various components thereof shown cut away.

A status light 12 is mounted on the upper portion **11*a* of the cover and indicates when the apparatus is operating. On a front portion 11*b* of the cover 11 is mounted a fluid monitoring indicator 13 and a fluid mix control 14. The fluid monitoring indicator 13 reflects the level of fluid (e.g., etch solution) accumulated within a compartment 15 of a storage tank 16, disposed within the housing 9, through a float assembly 13*a* (FIG. 2). A small pointer or the like 13*b* connected to an upright rod 13*c* forming a part of the assembly 13*a*, moves up or down along an elongated slot 13*d* provided in cover portion 11*b* in response to a change in fluid level within compartment 15. A hinged door 17 is provided in the lower portion 11***c* of the cover to allow access to compartment 15. When the pointer 13*b* reaches a predetermined position relative to slot 13*d*, fluid may either be manually added to compartment 15 through door 17 or automatically fed into the compartment 15 by way of a known valve/float assembly, with the fluid being provided from an outside source (not shown).

Figure 3:
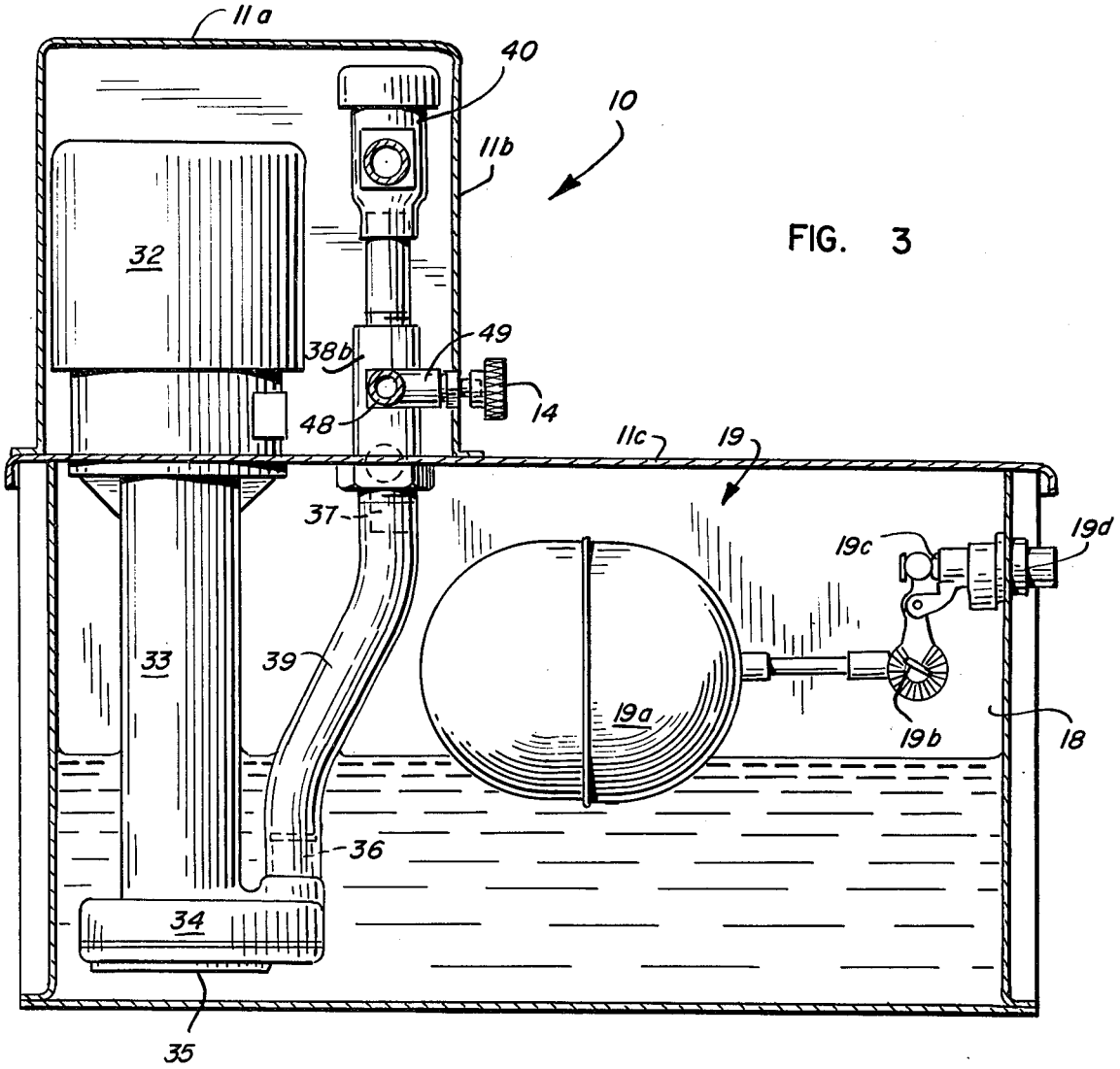
FIG. 3 is an enlarged sectional view taken along lines 3—3 of FIG. 1.

A second compartment 18 is provided in the storage tank 16 and is disposed adjacent compartment 15. A valve/float assembly 19 (see FIG. 3) is located within compartment 18 and is adapted to maintain therein a predetermined level of fluid (e.g., water). As the fluid level falls, a float 19*a*, forming a part of the assembly 19, will move downwardly with the fluid level and cause a lever 19*b* to pivot, thereby opening a valve 19*c* mounted on a wall of the compartment. The valve 19*c* is connected to an outside source of the desired fluid at a fitting 19*d*. When the water level again rises, the float moves in an opposite direction, closing valve 19*c* and stopping further flow of fluid into the compartment.

The apparatus 10 is connected to a source of electricity through suitable wiring 20. An outlet port 21 is provided on an upper side wall portion 11*d* of cover 11 to which suitable piping or hose 21*a* may be connected. With the fluid mix control 14 manually adjusted to a desired setting and the apparatus in an operational mode, as indicated by light 12, a desired mixture of the two fluids (e.g., etch and water) will flow through the piping 21*a*, as will be described more fully hereinafter.

Referring now to FIG. 2, it will be noted that compartments 15 and 18 of storage tank 16 are approximately equal in volume, each, for example, being adapted to hold 2½ gallons of fluid. A portion 11*c* of the cover 11, which overlies the storage tank 16, has mounted thereon a pump 31. The pump motor 32 has depending therefrom a pump column 33 which extends into compartment 18. A pump body 34 is connected to the lower end of the column and is provided with an intake 35 on the underside thereof and a discharge port 36 on an upper surface thereof. The discharge port 36 is connected to a suitable fitting 37 mounted on a cover portion 11*c*, by means of a tube section 39. Fitting 37 forms the inlet end of a primary conduit 38.

Primary conduit 38 extends upwardly from fitting 37 and includes a vacuum breaker 40. Extending laterally from the vacuum breaker is a conduit section 38*a* to which is connected a first inlet side 41*a* of an eductor 41. The discharge side 41*b* of the eductor is connected to the outlet port 21.

As seen in FIG. 2, a secondary conduit 42 is provided which extends upwardly from compartment 15 through an opening 43 formed in cover portion 11*c*. Attached to the lower end 44 of conduit 42 is a conventional one-way valve 45 which allows fluid (etch) to enter conduit 42, but will now allow the fluid in conduit 42 to return to compartment 15 and mix with the fluid remaining in the compartment 15. A cylindrical screen 46, extending from the underside of cover 11*c* to the base 47 of the compartment 15, encompasses the conduit 42 and valve 45 thereby preventing impurities in the etch, drawn from compartment 15, from clogging the conduit 42. The secondary conduit 42 extends upwardly from compartment 15 to a T-connector 42*a* and from there to a second inlet 41*c* of the eductor 41.

Interconnecting the primary and secondary conduits 38 and 42 respectively, is a diversion conduit 48. The diversion conduit is disposed substantially perpendicular to conduits 38 and 42, and is connected to the primary conduit 38 at junction fitting 38*b* and is connected to the secondary conduit 42 at the T connector 42*a*. Fitting 38*b* is located upstream from vacuum breaker 40, as seen in FIG. 2.

The fluid mix control 14, previously mentioned, is adapted to adjust the setting of a valve 49 (FIG. 3) which is located within the diversion conduit 48. Valve 49 controls the amount of fluid (water) which can be diverted from primary conduit 38 at the junction fitting 38*b*.

The relative interior cross-sections of the secondary and diversion conduits 42 and 48 are of smaller dimension when compared to that of the primary conduit 38. Thus, even though valve 49 is in a fully open position only a relatively small amount of fluid in the primary conduit 38 will be diverted through conduit 48, thereby assuring that there is a continuous flow of fluid from conduit section 38*a* through the eductor 41 when pump 31 is operating.

In operation, water from compartment 18 is drawn into pump body 34 through intake 35 and discharged under a predetermined pressure through outlet 36 and tube 39 into the primary conduit 38. When the water reaches junction fitting 38*b*, a portion thereof will be diverted into conduit 48 depending uppn the setting of valve 49. Notwithstanding the diversion conduit 48, most fluid will flow through the primary conduit 38 past vacuum breaker 40 and into the first inlet 41*a* of the eductor. The vacuum breaker relieves any vacuum build-up that might occur when the apparatus is shut down. When the apparatus is operational, however, the vacuum breaker 40 does not interfere with fluid flow through the primary conduit.

The flow of water, under pressure, through the restricted venturi-like passageway V of the eductor 41 generates a suction force in the secondary conduit 42, the latter being connected to the second inlet 41*c* of the eductor. At a predetermined flow of water through the passageway V, enough suction will be generated to draw fluid (etch) from compartment 15 to T-connector 42*a* whereupon it will intermix with the fluid flowing through diversion conduit 48. The mixture then passes through inlet 41*c* into passageway V. Depending on the setting of valve 49 the extent to which the etch will be diluted prior to reaching passageway V can be accurately controlled. Therefore, although the suction force generated by the flow of water from the primary conduit through the eductor 41 will remain nearly constant, the proportion of etch to be mixed therewith may be varied depending on the amount of water that is allowed to flow through the diversion conduit 48. The more water allowed to enter conduit 42 at the T-connector 42*a*, the greater the quantity of etch that will be displaced in secondary conduit 42 upstream of T-connector 42*a*, resulting in a more dilute etch and water mixture flowing to the eductor 41. Water entering the conduit 42 at connector 42*a* is prevented from flowing down conduit 42 into compartment 15 by the one-way valve 45. In the preferred embodiment, the amount of etch entrained with the water is variable between one and six ounces per gallon of water.

The outlet tube 21*a* which is connected to port 21 may be curved downwardly so as to allow gravity to assist in the movement of the mixture flowing from the apparatus. While the mixture has been illustrated and described as being discharged from the apparatus through suitable piping, it should be understood that the fluid mixture may be directly discharged from tube 21*a* into a portable batch collector.

Thus, it will be noted that an improved mixing apparatus is provided that is of simple and uncomplicated construction, is inexpensive to manufacture, yet accurate, reliable and versatile in operation.

For example, it is apparent that a mixing apparatus according to this invention may employ conduits of varying sizes, and/or a multitude of eductor configurations. Furthermore, the apparatus may be readily adapted to accurately control the mixing of three or more fluids. Neither is it anticipated that the invention is to be employed solely in conjunction with printing presses, as the teachings of this invention may be applied to a variety of situations wherein it is desirable to mix fluids. It is, therefore, contemplated by the appended claims to cover any such modifications or other embodiments and incorporate those features which constitute the essential features of this invention within the true spirit and scope of the following claims.

What is claimed is:

1. An apparatus for mixing a first fluid under pressure from a first source with a second fluid from a second source, comprising a primary conduit having an inlet communicating with the first fluid in the first source, and an outlet; a secondary conduit having an inlet communicating with the second fluid in the second source, and an outlet; a diversion conduit having an inlet connected to said primary conduit upstream of the primary conduit outlet and an outlet connected to said secondary conduit upstream of the outlet thereof; valve means for regulating the flow of the first fluid from said primary conduit through said diversion conduit, said valve means being adjustable between open and closed positions; and eductor means having an outlet and a primary inlet, the latter being connected to said primary conduit outlet and disposed downstream of the connection between said primary and diversion conduits, said eductor means being provided with a suction inlet intermediate the primary inlet and outlet of said eductor means, said suction inlet being connected to the secondary conduit outlet and downstream of the connection between said secondary and diversion conduits, said valve means, when in said closed position, effecting flow cut-off of said first fluid through said diversion conduit and maximum flow of said second fluid through said secondary conduit to said eductor, and when in said open position, effecting maximum flow of said first fluid through said diversion conduit and minimum flow of said second fluid through said secondary conduit to said eductor, whereby a continuous fluid flow through at least said secondary conduit downstream of the connection with said diversion conduit occurs when the first fluid in said primary conduit flows through the primary inlet and outlet of said eductor means.

2. The apparatus of claim 1, wherein the second conduit is unrestricted from the source of said second fluid to said suction inlet of said eductor means.

3. The apparatus of claim 2, wherein the primary conduit is unrestricted from the source of said first fluid to the primary inlet of said eductor means.

4. The apparatus of claim 2, wherein one compartment of said storage tank includes a pump for said first fluid.

5. The apparatus of claim 1, wherein the first fluid flow through said diversion conduit intermixes with the second fluid flow through said secondary conduit upstream of the connection between the outlet of said secondary conduit and said eductor means.

6. The apparatus of claim 1, wherein said valve means is manually adjustable and for each setting of said valve means other than fully closed, a predetermined proportion of the second fluid to the first fluid flow through the diversion conduit, will be maintained notwithstanding predetermined variations in first fluid flow through said eductor means.

7. A method for mixing first and second fluids in a desired proportion comprising, 1. Directing a predetermined flow of the first fluid under pressure through a primary conduit and through an eductor means disposed within said primary conduit;
2. Drawing second fluid through a second conduit connected to a suction inlet of the eductor means;
3. Diverting upstream of the eductor means a preselected amount of the first fluid from the primary conduit while the remainder of the first fluid continues to flow through the eductor means producing a predetermined suction at the suction inlet of the eductor means;
4. Drawing the second fluid and the diverted first fluid simultaneously into the second conduit upstream of the eductor suction inlet, to form a premixture, whereby the amount of second fluid in the premixture is dependent solely upon the suction force generated in the second conduit by the eductor means, and the amount of first fluid diverted into the second conduit;
5. Entraining a constant volume of pre-mixture, from the second conduit and through the suction inlet of the eductor means, with the first fluid flowing through the primary conduit and the eductor means.

8. The method of claim 7, wherein the diversion of the first fluid to the second conduit is manually controlled.

9. The apparatus of claim 1, including a compartmented storage tank for accommodating the sources of said fluids integral with said apparatus.

* * * * *

UNITED STATES PATENT AND TRADEMARK OFFICE

CERTIFICATE OF CORRECTION

PATENT NO. : 4,058,296

DATED : November 15, 1977

INVENTOR(S) : Edward M. Wetherby

It is certified that error appears in the above-identified patent and that said Letters Patent are hereby corrected as shown below:

Abstract line 9 "position" should read -- positioned --.

Col. 2, line 14 - "of" should read -- to --.

Col. 3, line 29 - after "flow" insert -- out --.

Col. 3, line 56 - "now" should read -- not --.

Col. 4, line 26 - "uppn" should read -- upon --.

Col. 6, Claim 4, line 7 - "claim 2" should be -- claim 9 --.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*